US007905191B2

(12) United States Patent
Hall et al.

(10) Patent No.: US 7,905,191 B2
(45) Date of Patent: Mar. 15, 2011

(54) GAS EXPANSION TRUNK FOR MARINE VESSELS

(75) Inventors: Ian Hall, Dubai (AE); Thomas J. Scott, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/564,608

(22) PCT Filed: Jul. 16, 2004

(86) PCT No.: PCT/US2004/023122

§ 371 (c)(1),
(2), (4) Date: Jul. 13, 2006

(87) PCT Pub. No.: WO2005/009876

PCT Pub. Date: Feb. 3, 2005

(65) Prior Publication Data

US 2007/0034131 A1 Feb. 15, 2007

Related U.S. Application Data

(60) Provisional application No. 60/488,353, filed on Jul. 17, 2003.

(51) Int. Cl.
*B63B 25/08* (2006.01)
*B63B 5/00* (2006.01)

(52) U.S. Cl. ..... 114/74 R; 114/85

(58) Field of Classification Search ..... 114/74 R, 114/74 A, 85

See application file for complete search history.

(56) References Cited

U.S. PATENT DOCUMENTS

| | | | | | |
|---|---|---|---|---|---|
| 1,085,086 | A | | 1/1914 | Jack | |
| 1,806,740 | A | | 5/1931 | Butterworth | |
| 3,851,611 | A | | 12/1974 | Yamamoto | |
| 4,144,829 | A | | 3/1979 | Conway | |
| 4,233,922 | A | * | 11/1980 | Conway | 114/74 R |
| 4,292,909 | A | | 10/1981 | Conway | |
| 5,398,629 | A | | 3/1995 | Wasenius | |

OTHER PUBLICATIONS

WO 2005/009876A3—International Search Report Dated Feb. 3, 2005 of corresponding PCT/US2004/023122.

* cited by examiner

*Primary Examiner* — Daniel V Venne
(74) *Attorney, Agent, or Firm* — Abelman, Frayne & Schwab

(57) ABSTRACT

A liquid cargo carrying maritime vessel including a plurality of liquid cargo carrying tanks and a plurality of gas expansion trunks wherein each gas expansion trunk is above, associated with, and in fluid communication with a respective tank therebelow, via slotted apertures in the deck. Each gas expansion trunk is fixedly positioned on a portion of a deck of the vessel above the associated tank and in fluid/tight relationship with the deck over a periphery of the trunk which encloses the totality of slotted apertures in the deck. Depending on the attributes of the ship, the expansion trunk is preferably located directly above the tank and at the highest point available of the tank and as far forward on the tank as possible. Alternatively, and depending upon obstructive constraints and vessel conditions, the trunk may be placed in other locations such as aftmost on the tank or inbetween. Gas expansion trunks are suitable for being retrofitted onto existing ships or integrated into the configuration of new ships.

12 Claims, 5 Drawing Sheets

GAS EXPANSION TRUNK FOR MARINE VESSELS

CROSS-REFERENCE TO RELATED APPLICATIONS

This application claims priority to U.S. Provisional Application No. 60/488,353 filed Jul. 17, 2003, the disclosure of which is incorporated by reference herein and is made a part of this application.

BACKGROUND OF THE INVENTION

1. Field of the Invention

The invention relates to the construction of marine vessels carry liquid cargos such as very large crude oil carriers ("VLCC"), and specifically to the requirements for providing cargo expansion space during transit.

2. Description of Related Art

The International Convention for the Prevention of Marine Pollution from Land-Based Sources (MARPOL) design requirements for marine vessels have substantially reduced the actual cubic capacity of tankers, in some cases by as much as 20%-30%. For example, tanker capacity has been reduced by 2% to 3% as a result of the double hull requirement of MARPOL Annex 1, 13F & G and by 2% as a result of the MARPOL regulation requiring a 2% headspace in each tank of a vessel for heat expansion. MARPOL sets numerous standards for such vessels, one being the standard for crude oil washing commonly referred to as "COW".

While oil is typically sold in volume, tankers earn freight by the amount of liquid cargo they carry in weight. Thus, if a ship's internal volume, (referred to as "cubic capacity" or simply "capacity") is increased, the ship can earn increased freight income by the amount of weight the volume can accommodate. The increase in income can be calculated as cubic meters times specific gravity of cargo times freight rate in dollars.

Numerous patents address venting hydrocarbon gases and overflow prevention systems, but do not address problems and solutions relative to the reduction of cubic capacity in ships as a result of MARPOL regulations. In U.S. Pat. No. 3,851,611 to Yamamoto, a tank for low temperature liquefied gas tanker ship is described wherein the tank has a flexible membranous lower portion below the hull and a rigid, but flexibly attached upper portion above the hull deck. A fluid tight connection between the portions is maintained through the deck.

The tank in Yamamoto, including the upper portion, is filled with liquefied gas to enhance the stability of the overall ship and provide more room for the liquefied gas. The upper portion provides enhanced stability because its reduced horizontal cross-sectional area has a smaller free surface area that is further enhanced by partitions. Yamamoto, however, increases ship instability by raising the center of gravity of the liquefied gas through the filling of the upper tank positioned above the deck and allowing for the flexible shifting of the rigid upper central portion relative to the lower portion of the tank. Yamamoto has the upper portion of the tank centrally positioned above the membranous lower tank, but does not address any reason or any advantages for the positioning of the upper tank.

In U.S. Pat. No. 4,144,829 to Conway discloses a system for the venting of hydrocarbon gasses including utilizing the ship's existing pressure/vacuum relief valved venting system and expansion trunk (19) which opens downwardly into the cargo compartment to which it is coupled. See col. 3, lines 40-60. Conway '829, however, connects adjacent cargo compartments with valves 20 and pipes 21 and does not discuss any advantageous location of the expansion trunk or the volume enclosed by the expansion trunk.

In U.S. Pat. No. 4,292,909 to Conway, a trunk line is disclosed placing cargo expansion trunks (16) in fluid communication with a retention tank (21) configured for receiving any spill overflow during the loading of petroleum products. Thus, Conway '909 interconnects trunks (16) as part of an overflow prevention system and does not address advantageous location of the trunks (16), the volume enclosed by the trunks (16), or the integration of pipelines for crude oil washing.

In U.S. Pat. No. 4,233,922 to Conway, a fluid transfer system for vessels is disclosed for containing and transferring of contaminated gasses formed by fluid chemical and petroleum products. The fluid transfer system includes placing a plurality of cargo expansion trunks coupled with and opening downwardly into each cargo compartment which are in fluid communication with a branch vent line and a longitudinally disposed trunk vent line. While Conway '922 discusses in detail the use of the trunks as conduits, it does not address the size of the expansion trunk in relation to MARPOL expansion requirements, any advantageous location of the expansion trunk, or any integration of the requirement for crude oil washing.

A need exists for an improved carrying capacity for maritime tankers that can meet MARPOL requirements for the 2% headroom expansion using a gas expansion trunk located above deck and be in compliance with other MARPOL requirements, such as crude oil washing.

SUMMARY OF THE INVENTION

A marine vessel includes a plurality of separate liquid cargo tanks located below deck plates. A portion of the deck plates located above each of the plurality of tanks includes a plurality of openings communicating with the tank below. A separate expansion trunk is secured in fluid-tight relation to the deck plate and surrounds the plurality of openings in the deck plate above each tank. The expansion trunk forms an expansion space to serve the cargo in the tank below. The expansion trunk includes pipelines for venting the tank and for a crude oil washing machine.

The expansion trunk is preferably located above and on the forward portion of the tank. The plurality of openings are slots configured to provide openings having a sufficient area such that there is approximately less than a 0.5 psi pressure difference between the opposing tank side and trunk side of the trunk plates when the tank is being loaded at 200% of its maximum load rate. The slots are between approximately 2 and 3 centimeters wide and one half of the length of a deck plate. The expansion trunk has an interior volume of at least 2% of the amount of under deck space used for liquid cargo storage. The slots are positioned in one or more deck plates.

A marine vessel is disclosed having a plurality of separate liquid cargo tanks located below the deck plate, the tanks having a generally highest point above the baseline of the ship. At least a portion of the deck plate is located above each tank and each tank has a highest point above the baseline of the ship. The improvement of the present invention comprises a plurality of apertures in the deck plate communicating with the respective tank therebelow, the plurality of apertures being positioned substantially as close to the highest point available on the tank above tank above the baseline of the ship. A separate expansion trunk is positioned on the deck plate over the apertures, the trunk being secured in fluid-tight relation with the deck plate and surrounding the plurality of apertures in the deck plate above each tank. Each tank forms an expansion space to serve the cargo in the respective tank therebelow, the expansion trunk being in fluid communication with pipelines for the venting of the tank. Each expansion trunk is preferably located directly above the respective tank therebelow and as far forward as possible. Further, the plurality of apertures are preferably elongated slots configured to provide openings having a sufficient area such that there is approximately less than about a 0.5 pound per square inch pressure difference between the opposing tank side and trunk side of said deck plates when the tank is being loaded at 200% of its maximum load rate. The slots are preferably between approximately 2 and 3 centimeters wide and one half of the length of a deck plate and each expansion trunk preferably has an interior volume of at least 2% of the volume of the respective tank therebelow for liquid cargo storage. The apertures in the deck are positioned in one or more deck plates and may also be located directly over each associated tank and as far aft on the tank as possible. In a preferred embodiment, each said trunk has dimensions of between about 10 to 40 meters in length, about 5 to 15 meters wide and about 2 to 3 meters high.

A system is also disclosed for fluid storage for transport, which comprises a plurality of separate liquid cargo tanks located below a deck plate of a marine vessel, a portion of the deck plate located above each tank being provided with a plurality of apertures communicating with the tank therebelow. A separate expansion trunk is secured in fluid-tight relation with the deck plate and surrounds the plurality of apertures in the deck plate above each tank, to thereby form an expansion space to serve the fluid cargo in the tank therebelow. The expansion trunk includes pipelines for venting the tank and enclosing a volume at least that required for compliance with maritime regulations for an expansion space for liquid cargo storage. The expansion space of each expansion trunk for fluid cargo storage is preferably about 2% of the amount of under deck space for use as fluid cargo storage. Further, each expansion trunk is preferably located directly above the associated tank and as far forward as possible, but depending on obstructions, deck conditions and stern or bow trim, each expansion trunk is preferably located directly above the associated tank and as far aft as possible, or even in between the aftmost and foremost positions. Each expansion trunk is preferably located at the highest point in the associated tank above the baseline of the vessel and preferably includes a crude oil washing pipeline and is configured for being connected with one or more of a removable crude oil washing machine or a permanently installed crude oil pipeline washing machine.

In a preferred embodiment, each expansion trunk includes at least one side wall and a top wall, said side wall and top wall each having inner sides, the inner sides being at least substantially free from one or more primary structural members of the trunk. The apertures are preferably in the form of elongated slots which are configured such that there is approximately less than a 0.5 pound per square inch pressure difference between the opposing tank side and trunk side of the deck plates when the tank is being loaded at 200% of its maximum load rate. The slots are preferably approximately between 2 and 3 centimeters wide and are approximately one half of the length of a deck plate.

The trunk preferably has dimensions of between about 10 to 40 meters in length, about 5 to 15 meters wide and about 2 to 3 meters high and each trunk preferably includes an alternative vent line. The associated tank preferably has a highest point in the tank above the baseline of the ship, said alternative vent line being in fluid communication with the highest point in the tank above the baseline of the ship.

BRIEF DESCRIPTION OF THE DRAWINGS

Preferred embodiments of the invention will be described hereinbelow with reference to the drawings, wherein.

DETAILED DESCRIPTION OF THE INVENTION

Figure 1:
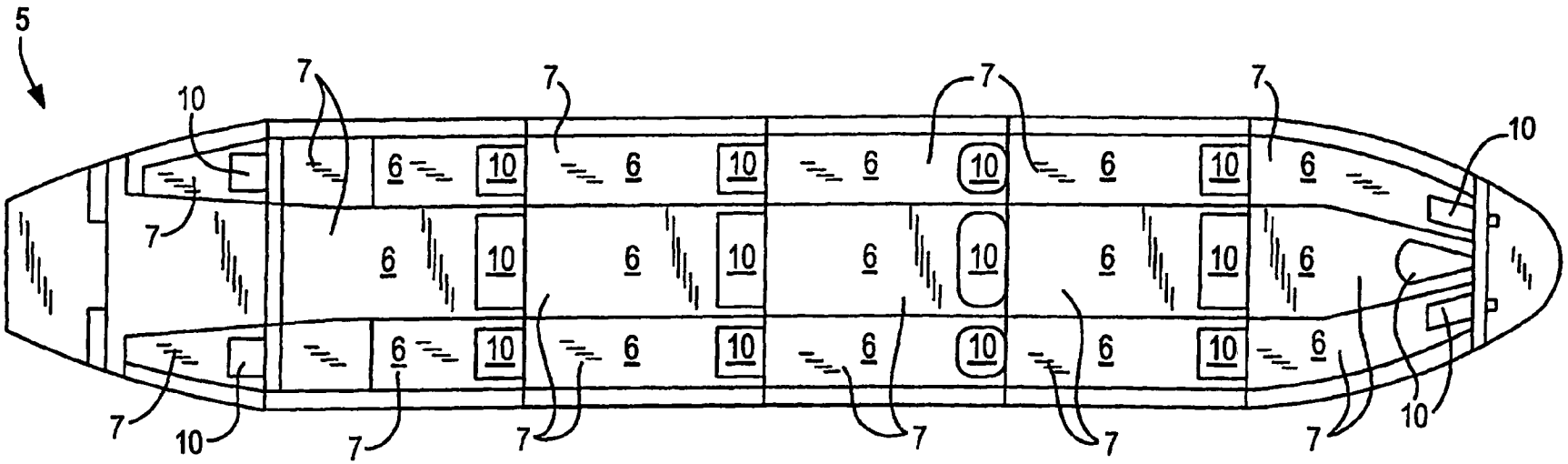
FIG. 1 is a top view of a liquid cargo vessel constructed according to the present invention, the deck being positioned over a plurality of tanks and a plurality of gas expansion trunks located on the deck and above the tanks such that each trunk is directly above and located as far forward as possible over its respective tank.
Figure 2:
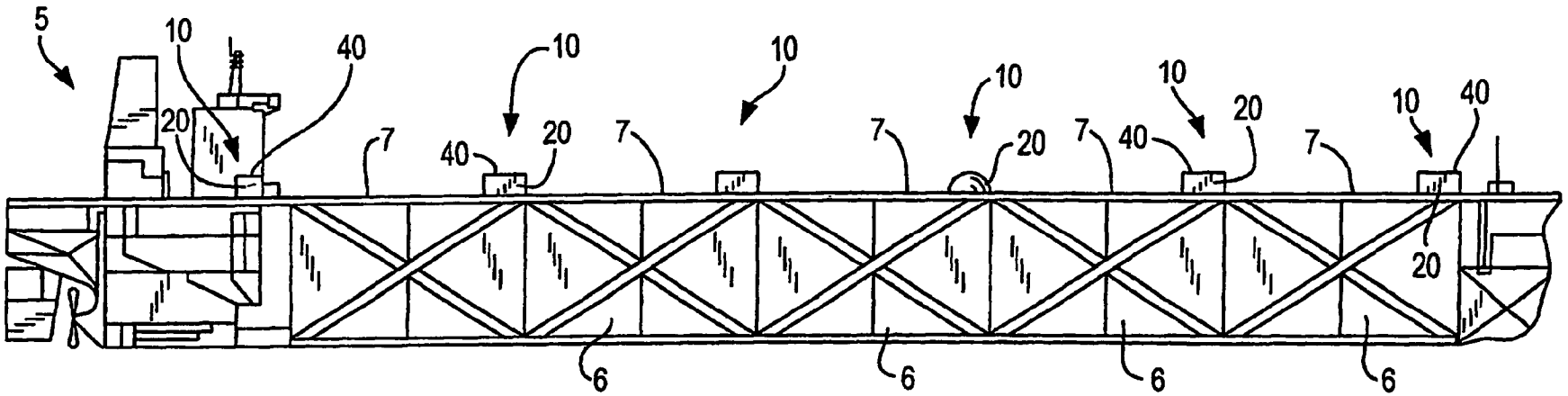
FIG. 2 is an elevational view of the vessel of FIG. 1, showing the plurality of gas expansions trunks positioned atop the deck of the liquid cargo ship.

Referring initially to FIGS. 1-2 there is shown a top view of a marine vessel 5 (i.e. tanker) including a hull having a bottom, sides and a deck 7. A plurality of segregated tanks 6 is positioned in the hull and a plurality of gas expansion trunks 10 are located on deck 7 and external to the hull such that there is at least one gas expansion trunk 10 corresponding to and in fluid communication with each tank 6. While gas expansion trunks 10 can be utilized to greatest advantage on double hull tankers that have poor cubic capacities when compared to single hull tankers, it should be understood that such gas expansion trunks 10 are applicable for use in any shipboard application where there is a need to allocate space for the expansion of the liquid cargo.

The purpose of the present invention is to allow the "Topping Off" of each tank 6 at the deck-head of each tank 6 rather than 2% below the deck, by creating a space to accommodate the heat expansion of the liquid cargo in the above deck trunk 10. Expansion trunks 10 are configured to meet the need for additional space for the heat expansion of the liquid cargo itself as well as any gasses or vapors which may be produced during the transfer or shipment of the liquid cargo. The trunks 10 increase the cubic capacity of liquid cargo and thereby increase the cost effectiveness of tankers while retaining compliance with MARPOL regulations.

Figure 3:
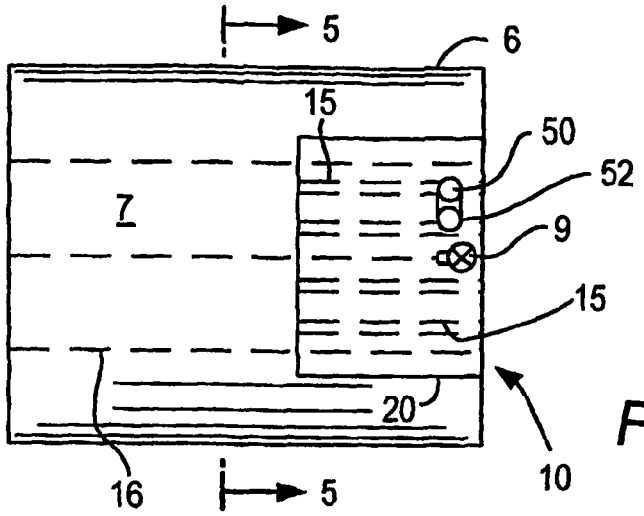
FIG. 3 is a top view of one of the liquid tanks of FIG. 1 with the gas expansion trunk removed for illustration purposes and showing the slots in the deck located forwardmost on the tank.
Figure 4:
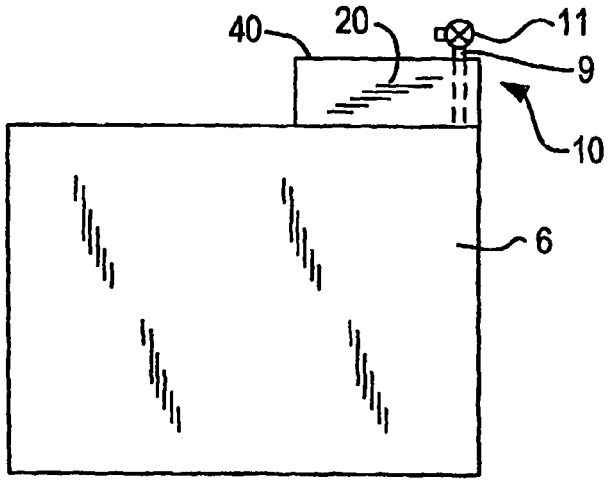
FIG. 4 is an elevational view of the tank of FIG. 3 with the gas expansion trunk in position and located forwardmost on the tank.
Figure 5:
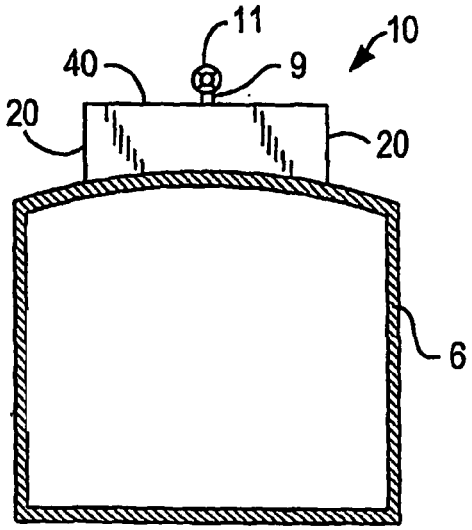
FIG. 5 is an elevational rear view of the tank of FIG. 3 taken along lines 5-5 of FIG. 3 with the gas expansion trunk located forward and on the centerline of the tank, the tank having a camber peaking at the centerline.
Figure 7:
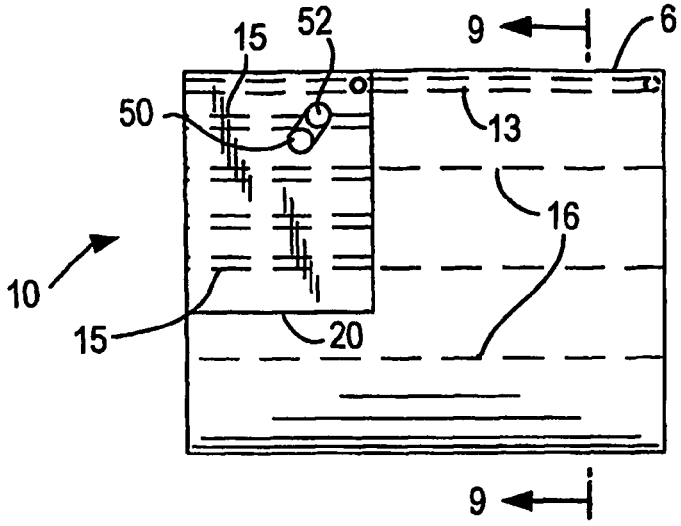
FIG. 7 is a top view of one of the tanks of FIG. 6 with the gas expansion trunk located aft with the top of the trunk removed for illustration purposes, and showing the slots in the deck and an alternative vent line.

As shown in FIGS. 3-5, the location of each trunk 10 relative to tank 6 can vary with its intended application and with shipboard space available on the deck, for example, of any particular vessel. Trunk 10 is preferably located at the highest available point or points of tank 6 above the baseline of vessel 5 so that existing piping, conduit and mooring equipment need not be moved or obstructed. Deck 7 frequently coincides with, forms part of and/or is parallel to tank 6 and preferably has a camber in the top of tank 6 and/or deck 7 that defines the highest point of tank 6. This "highest point" can be, for example, a fore-aft centerline of tank 6, a side of tank 6 or even a "corner" of the deck 7 over tank 6 depending upon the construction of ship 5 and location of tank 6 in ship 5 (see FIGS. 7-9).

The highest point of tank 6 that is above the baseline of vessel 5 is usually as far forward as possible in each tank 6 because vessels 5 typically load and transport cargo with a stern trim (i.e. with bow up) in order to keep a more seaworthy and efficient slightly aft center of gravity. For example, a bow up permits the vessel cut through the water with greater efficiency. The terms forwardmost and aftmost as used herein mean as far forward and as far aft as possible given the shipboard constraints of any particular vessel.

In FIGS. 3-5, existing vent pipelines 9 for tank 6 can be integrated into and vent from trunk 10, retrofitted and integrated with trunk 10 or incorporated into an original design embodying the invention.

Gas expansion trunk 10 preferably includes one or more walls 20 and/or a top 40 defining a fluid-tight structure. As will be apparent to one of ordinary skill in the art, the external configuration of trunks 10 can be sloped, curvilinear, conical or dome-shaped, for example, to reduce the lateral forces of waves impacting on sidewalls 20 as well as vertical walls 20 and flat horizontal top 40. Existing vent lines 9 are in fluid communication with trunk 10 and the external atmosphere through one or more valves, such as check valves, as is known in the industry.

Trunk 10 can also include COW lines 50 and/or a COW machine 52 (shown in fluid communication in FIG. 3) for compliance with MARPOL requirements. In one preferred embodiment, walls 20 and top 40 have inner sides in which interruptions by large primary structural members or their equivalents is minimized such that portions of the wall, deck or top are not shielded from the direct impingement, jet deflection, or splashing of the COW machine 52. This can reduce the time and number of machines required for COW. The expansion trunk 10 can be made of any material suitable for use on deck 7 of tanker 5, but is preferably made of the same material as the ship's deck 7, and is appropriately reinforced to withstand the force of the sea's impact on the structure of trunk 10.

Referring again to FIGS. 3-5, depending upon the size of tank 6, expansion trunks 10 can be, for example, 10 to 40 meters in length, 5 to 15 meters wide and 2 to 3 meters high. Each trunk 10 is built directly on deck 7 immediately above the tank 6 which it serves, thereby enabling the safe increase of the liquid cargo carrying capacity of each tank 6 by about 2% or between approximately 100 and 1,800 cubic meters. Further, this improvement allows ship 5 to increase its overall liquid carrying capacity by up to approximately 2% or about 7000 tons on the 300,000 dwt ton tanker of 350,000+ cubic meters.

Referring now once again to FIGS. 1-5, the plates of deck 7 enclosed by the expansion trunks 10 are cut with sufficient slots 15 to allow free fluid communication between the existing tank 6 and the associated superposed expansion trunk 10. Slots 15 are cut between the deck 7 longitudinals 16 on a sufficient number of deck 7 plates enclosed by the expansion trunk 10 according to the Classification Society rules that govern the ship's Stability and Trim rules. The size and arrangement of the slots 15 is designed to minimize strength losses in deck 7 plates and are typically 2 to 3 cm wide by about ½ of the length of the plate. Not every deck 7 plate must be slotted, but sufficient slots 15 are provided so that there is less than 0.5 psi difference between the opposing sides of deck 7 plates at 200% of the tank's 6 maximum loading rate. Slots 15 may be substituted by alternatively shaped apertures sufficient in dimensions to permit the fluid transfer rates defined herein between the tank 6 and the associated trunk 10.

Figure 6:
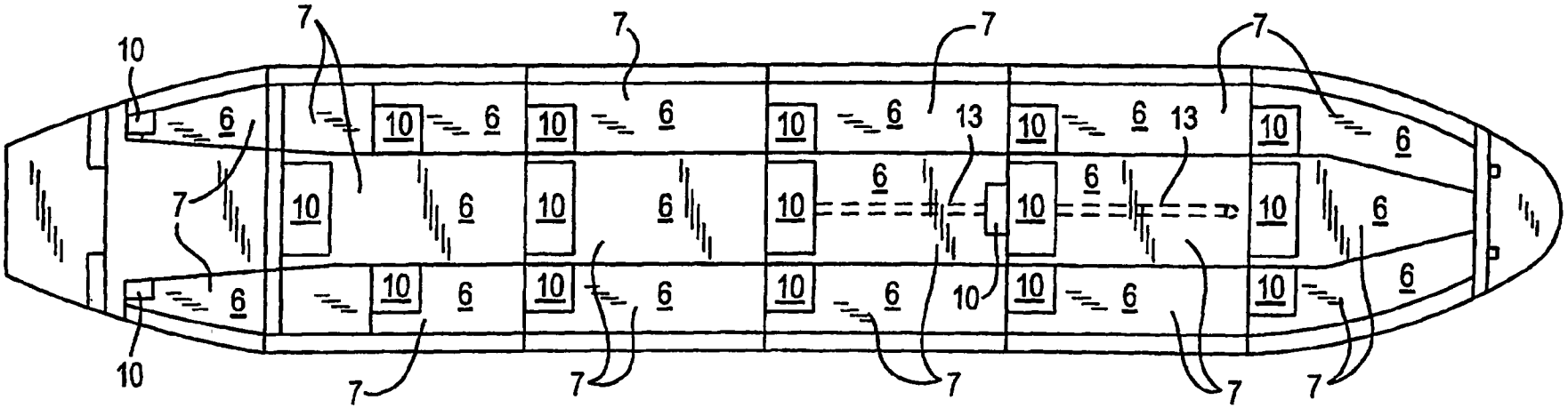
FIG. 6 is a top view of an alternative embodiment of the liquid cargo vessel constructed according to the present invention, having a plurality of tanks positioned beneath the deck of the vessel and a plurality of gas expansion trunks located on the deck above the tanks such that each trunk is directly above and located as far aft as possible over its respective tank.

As shown in FIG. 6, due to the complexity of the requirements for vessels and the limited space available on decks 7, trunk 10 can be located at any alternate location on the deck above the corresponding tank 6 to include, for example, locating trunk 10 as far aft as possible over tank 6. Alternative locations of trunks 10 can further include alternative vent pipelines 13 connected within tanks 6 between the highest point of tank 6 and trunk 10 for the venting of any accumulated gases from the highest point in tank 6 to trunk 10 and then to the atmosphere. In this configuration, the aft alternative location of trunk 10 can also contribute a slight increase in the aft weight distribution to the stern trim. As shown in FIGS. 4 and 5, each trunk 6 is provided with vent lines 9 which include a backflow prevention valve 11 to prevent liquid from exiting the vent line 9. Valve 11 may also be used to selectively control the venting of vapors from trunk 10 and tank 6.

Figure 8:
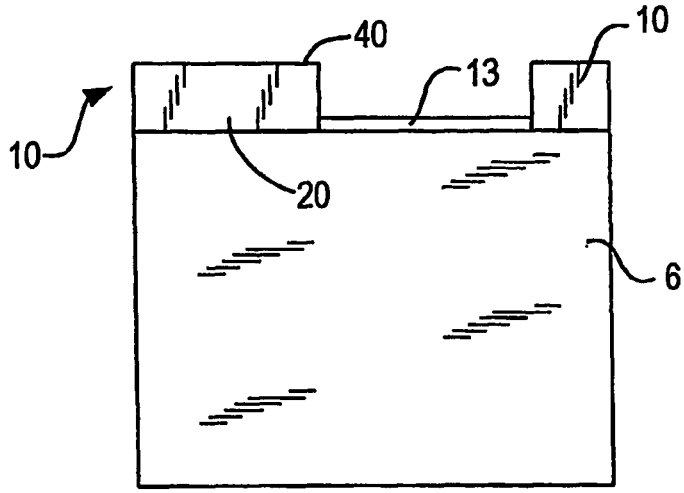
FIG. 8 is an elevational view of another alternative embodiment of one tank of the vessel of FIG. 6, the gas expansion trunk being located aftmost on the tank in fluid communication with a second trunk located forwardmost on the tank.
Figure 9:
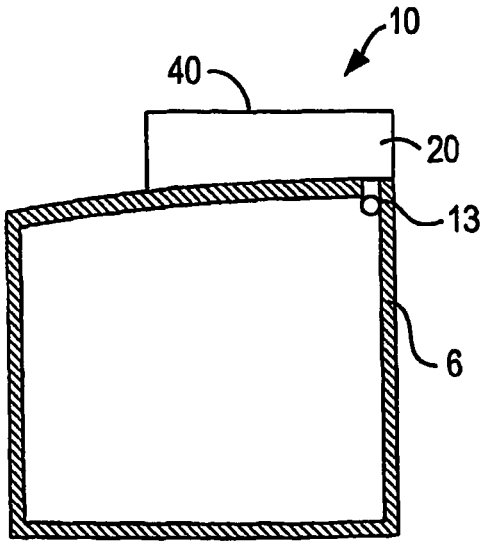
FIG. 9 is a rear view of the tank of FIG. 7 taken along lines 9-9 of FIG. 7, with the gas expansion trunk located aftmost and at one of the highest points of the tank above the baseline, the tank having a camber peaking on the starboard side of the tank.

Referring now to FIGS. 6-9, it should be understood that some vessels 5 may have difficulty in maintaining a stern trim in many instances such as at slow speeds, during loading or during offloading. In these instances, the highest point of tank 6 and the alternative locations of trunk 10 over tank 6 can also coincide. As a result of deck space limitations and the above instances of the difficulty of maintaining a stern trim, trunks 10 can include one or more combinations of locations of trunks 10 over one tank 6. These locations of trunks 10 on a single tank can include, for example, two or more trunks 10 in fluid communication using an alternative vent pipeline 13 (FIG. 6); using the liquid cargo pressure to force vapors at the highest point in tank 6 into alternative vent pipelines 13 from the highest point in tank 6 to an alternative highest point location in tank 6 in communication with trunk 10 (see FIGS. 6 and 7); and one trunk 10 as far forward as possible and a second trunk 10 as far aft as possible (FIG. 8).

Expansion trunks 10 can be constructed in any sequence of operations, but in one preferred embodiment, they may be constructed by initially cutting slots 15 into or "slotting" the existing plates of deck 7 between longitudinal supports 16 and installing the expansion trunk 10 around the slots 15 in fluid tight relationship with the deck. Alternatively, slots 15 can be cut into deck 7 after the positioning of one or more of walls 20 or top 40.

As will be apparent to one of ordinary skill in the art, the retrofitting or new construction of a vessel must comply with Classification Society rules for strength and stability. Each design alteration must be submitted to the ship's Classification Society for approval prior to installation. Although the regulations will not allow a vessel to carry a weight of cargo over and above the vessel's registered deadweight, the employment of the invention will allow loading of 100% of the vessel's existing registered deadweight.

For example, expansion trunks 10 that are retrofitted on existing tankers 5 will be located on deck 7 so as to avoid existing piping, conduit and structures and minimize any structural changes. As required, existing venting via the ship's Inter Gas (IG) line and risers may need to be redirected so that tanks 6 vent through the expansion trunks 10 rather than through existing fittings positioned external of trunks 10. Additionally, crude oil washing (COW) piping 50 and machines 52 will have to be retrofitted in line with Classification Society requirements and the Trim and Stability Book, will have to be re-calculated to include the added space and deck structures. This mode of construction will comply to the maximum extent possible with the requirements of the Classification Societies.

Referring now to FIGS. 1-6, in operation, tanks 6 having gas expansion trunks 10 that are topped off by being filled to the deck head, thereby maximizing the capacity of each tank 6 within load limits. Due to the stern trim of the ship, the highest point of the tank is in the forward portion of tank 6 where trunk 10 is preferably located. Existing vent lines 9 for tank 6 run through and are in fluid communication with trunk 10 for the external venting of vapors. Slots 15 are positioned and configured such that any pressure differential between trunk 10 and tank 6 is less than 0.5 psi when any liquid product is loaded at 200% of the maximum loading rate.

Upon completion of the loading of tanks 6, liquid cargo ship 5 transports its maximum rated load of liquid products in tanks 6. Upon arrival at the desired port, tanks 6 are off loaded minimizing any pressure differentials due to the configuration of slots 15. Upon completion of off loading, the one or more COW machines 52 are used to clean the interior of trunk 10, as required by regulations. Trunk 10 also includes one or more hatches in deck 7 within trunk 10 and/or in wall 20 or top 40 for the physical inspection and maintenance of trunk 10.

The present invention will provide every new and existing tanker 5, which complies with MARPOL design regulations with recoupment of lost volume. One of the benefits will be that freight revenue will increase as a result of having more space to load cargo. For example, a 2% increase in carrying capacity of the existing world's tanker fleet will reduce the number of VLCC's required during the forthcoming decades and therefore reduce the environmental impact of the increasing number of tankers 5 required to satisfy world demand for oil.

Furthermore, an increase in accordance with the present invention is estimated to lower the cost of delivering crude by about 2.5%. Such reduction of cost translates into the equivalent of about 50,000 barrels delivered free with each 2,000,000 barrels.

Having described the present invention by reference to the disclosed preferred embodiments, it will be apparent to those skilled in the art that various changes and modifications may be made thereto without departing from the scope and spirit of the invention, which is only limited by the claims. For example, the size and shape of many elements—such as tanks 6, trunk 10, slots 15, existing vents 9, alternative vents 13, COW lines 50 and COW machines 52 as well as their respective locations—may be modified without materially altering the invention. Also, the material of the trunk 10 is not limited to that of the deck 7. Furthermore, trunk 10 of the present invention may be used on other vessels, such as liquid carrying barges or smaller tanker vessels 5. Finally, the positions of the trunks with respect to the respective tanks may be varied in dependence upon obstructive conditions on the deck and/or trim conditions of the vessel, e.g. stern trim or bow trim. For these and other reasons, the embodiments shown and described are only illustrative, not restrictive.

What is claimed is:

1. A marine vessel having a plurality of separate liquid cargo tanks located below a deck plate, the tanks having a generally highest point above the baseline of the vessel, at least a portion of the deck plate being located above each tank and each tank having a highest point available above the baseline of the vessel, the improvement which comprises a plurality of apertures in the form of elongated slots in said deck plate communicating with the respective tank therebelow and configured to minimize loss of deck strength, said plurality of elongated slots being positioned proximate the highest point of the tank above the baseline of the vessel, and at least one separate and individual expansion trunk positioned on said deck plate and over said elongated slots, said trunk having an interior volume of at least 2% of the total capacity of the tank, and being between about 10 to 40 meters in length, about 5 to 15 meters wide, and about 2 to 3 meters high, said trunk being located directly above the respective tank therebelow and as far forward as possible with respect to said tank, said trunk further being secured in a fluid-tight relation with said deck plate and surrounding said plurality of apertures in said deck plate above each said respective tank to prevent leakage therebetween, to form an exclusive expansion space to serve the liquid cargo in the respective tank therebelow, said expansion trunk being in fluid communication with the venting system used for the venting of the tank.

2. The vessel according to claim 1, wherein said elongated slots in the deck are positioned in one or more deck plates.

3. The vessel according to claim 1, wherein said elongated slots in said deck plate are located directly over each associated tank and as far aft of the tank as possible.

4. A system for fluid storage for transport, which comprises a plurality of separate liquid cargo tanks located below a deck plate of a marine vessel, a portion of the deck plate located above each tank being provided with a plurality of apertures in the form of elongated slots which communicate with the tank therebelow and configured to minimize loss of deck strength, said plurality of elongated slots being positioned proximate the highest point of the tank above the baseline of the vessel, and at least one separate and individual expansion trunk located directly above the respective tank therebelow and as far forward as possible with respect to said tank, each said expansion trunk having dimensions of between about 10 and 40 meters in length, about 5 and 15 meters in width, and about 2 and 3 meters in height, said trunk having an interior volume of at least 2% of the total capacity of the tank, each said trunk further being secured in fluid-tight relation with the respective deck plate and surrounding said plurality of apertures in the deck plate above each associated tank to prevent leakage therebetween, to thereby form an exclusive expansion space to serve the fluid cargo in the respective tank therebelow, said elongated slots being between approximately 2 and 3 centimeters wide and about one-half the length of the deck plate, such that there is approximately less than 0.5 pound per square inch pressure difference between the opposing tank side and trunk side of said associated deck plate when the tank is being loaded at 200% of its maximum load rate, as determined by the pump, venting, and terminal restriction systems of the vessel, said expansion trunk being in fluid communication with the venting system used for venting the tank and enclosing a volume at least equal to that required for maritime regulations for an expansion space for liquid cargo storage, said at least one trunk not being associated with pipelines to receive fluids from said tank.

5. The system according to claim 4, wherein each said expansion trunk includes a crude oil washing pipeline and is configured for being connected with one or more of a removable crude oil washing machine or an installed crude oil pipeline washing machine.

6. The system according to claim 5, wherein each said expansion trunk includes at least one side wall and a top wall, said side wall and top wall each having inner sides, said inner sides being at least substantially free from one or more primary structural members of said trunk.

7. The system according to claim 4, wherein each said trunk includes an alternative vent line and the associated tank has a highest point in the tank above the baseline of the vessel, said alternative vent line being in fluid communication with the highest point in the tank above the baseline of the vessel.

8. A marine vessel comprising a plurality of liquid cargo tanks located below deck plates of a deck, and each tank having a portion of a respective deck plate as a highest point above the baseline of the vessel, which comprises:

a plurality of trunks positioned on the respective deck plates above each said tank, each respective deck plate being provided with a plurality of elongated apertures communicating with the respective tank therebelow and configured to minimize loss of deck strength, the portion of the tank located at the highest point above the baseline of the vessel being in communication with each said trunk, and each said trunk being located directly above the respective tank therebelow and as far forward as possible with respect to the respective tank, each said trunk being secured in fluid-tight relation with the deck plate above each said associated tank, to thereby form an exclusive expansion space to serve the liquid cargo in the tank therebelow, said elongated apertures being positioned proximate the highest point of the tank above the baseline of the vessel, and being elongated slots between approximately 2 and 3 centimeters wide and about one-half the length of the deck plate, such that there is approximately less than 0.5 pound per square inch pressure difference between the opposing tank side and trunk side of said associated deck plate when the tank is being loaded at 200% of its maximum load rate, as determined by the pump, venting, and terminal restriction systems of the vessel, each said expansion trunk being in fluid communication with the venting system used for the venting of the respective tank, and a vent pipeline in communication with each said trunk, which uses the liquid cargo pressure to force vapors from a first highest point in the tank to a second highest point location in the tank.

9. The marine vessel according to claim 8 wherein each said trunk is located above a portion of the tank located at the highest point above the baseline of the vessel, the portion of the tank above the highest point including one or more deck plates, the one or more deck plates having a plurality of elongated slots located within the periphery of said fluid-tight structure of said trunk and deck plates, and in fluid communication with said tank.

10. The marine vessel according to claim 8 wherein each said trunk is located above a portion of the tank, the portion of the tank being above the highest point thereof, said trunk being in liquid communication with the tank through a plurality of elongated slots in the associated deck plates beneath said trunk.

11. A marine vessel having a plurality of separate liquid cargo tanks located below a deck plate, the tanks having a generally highest point above the baseline of the vessel, at least a portion of the deck plate being located above each tank and as close as possible to the highest point above the baseline of the vessel, each said expansion trunk having dimensions of between about 10 and 40 meters in length, about 5 and 15 meters in width, and about 2 and 3 meters in height, the improvement which comprises a plurality of elongated apertures communicating with the tank therebelow and configured to minimize loss of deck strength, said elongated apertures being positioned proximate the highest point of the tank above the baseline of the vessel, and at least one separate and individual expansion trunk located directly above the respective tank therebelow and as far forward as possible with respect to the respective tank, each said trunk being secured in fluid-tight relation with said deck plate and surrounding said plurality of openings in said deck plate above each tank to prevent leakage therebetween, to thereby form an exclusive expansion space to serve the cargo in the tank therebelow, said expansion trunk being in fluid communication with the venting system used for the venting of the tank, said elongated apertures being elongated slots between approximately 2 and 3 centimeters wide and about one-half the length of the deck plate, such that there is approximately less than 0.5 pound per square inch pressure difference between the opposing tank side and trunk side of said associated deck plate when the tank is being loaded at 200% of its maximum load rate as determined by the pump, venting and terminal restriction systems of the vessel.

12. A marine vessel having a plurality of separate cargo tanks located below a deck plate, the tanks having a generally highest point above the baseline of the vessel, at least a portion of the deck plate being located above each said tank and each said tank having a highest point available above the baseline of the vessel, the improvement which comprises a plurality of elongated apertures in said deck plate communicating with the respective tank therebelow and configured to minimize loss of deck strength, said plurality of elongated apertures being positioned substantially as close to the highest point of the respective tank above the baseline of the vessel, and at least two separate expansion trunks positioned on said deck plate and over said elongated apertures, said trunks being located directly above the respective tank therebelow and as far forward as possible with respect to the respective tank, each said trunk being secured in fluid-tight relation with said deck plate and surrounding said plurality of elongated apertures in said deck plate above each said respective tank to prevent leakage therebetween, to thereby form an exclusive expansion space to serve the liquid cargo in the respective tank therebelow, each said expansion trunk being in fluid communication with the venting system used for the venting of the tank, said expansion trunks being in fluid communication with each other through at least one pipeline located at the highest point of the respective tank for the venting of the respective tank, said apertures being elongated slots between approximately 2 and 3 centimeters wide and about one-half the length of the deck plate, such that there is approximately less than 0.5 pound per square inch pressure difference between the opposing tank side and trunk side of said associated deck plate when the tank is being loaded at 200% of its maximum load rate as determined by the pump, venting, and terminal restriction systems of the vessel, and a vent pipeline in communication with each said trunk, which uses the liquid cargo pressure to force vapors from a first highest point in the tank to a second highest point location in the tank.

* * * * *